US012595420B2

(12) United States Patent
Eurlings

(10) Patent No.: US 12,595,420 B2
(45) Date of Patent: Apr. 7, 2026

(54) TORREFACTION UNIT AND METHOD

(71) Applicant: RWE GENERATION NL B.V., Geertruidenberg (NL)

(72) Inventor: Johannes Theodorus Gerardus Marie Eurlings, Obbicht (NL)

(73) Assignee: RWE GENERATION NL B.V., Geertruidenberg (NL)

( * ) Notice: Subject to any disclaimer, the term of this patent is extended or adjusted under 35 U.S.C. 154(b) by 95 days.

(21) Appl. No.: 18/559,737

(22) PCT Filed: Sep. 8, 2022

(86) PCT No.: PCT/EP2022/074950
§ 371 (c)(1),
(2) Date: Nov. 8, 2023

(87) PCT Pub. No.: WO2023/052073
PCT Pub. Date: Apr. 6, 2023

(65) Prior Publication Data

US 2024/0425757 A1 Dec. 26, 2024

(30) Foreign Application Priority Data

Oct. 1, 2021 (EP) ..... 21200579

(51) Int. Cl.
*C10B 47/26* (2006.01)
*C10B 5/10* (2006.01)
(Continued)

(52) U.S. Cl.
CPC ..... *C10B 47/26* (2013.01); *C10B 5/10* (2013.01); *C10B 53/02* (2013.01); *C10B 57/02* (2013.01);
(Continued)

(58) Field of Classification Search
CPC ..... C10B 5/10; C10B 47/26; C10B 53/02; C10B 57/02; C10B 57/14; C10J 3/725
See application file for complete search history.

(56) References Cited

U.S. PATENT DOCUMENTS 4,601,113 A * 7/1986 Draper ..... F26B 3/084 34/172
4,702,694 A 10/1987 Johnson et al.
(Continued)

FOREIGN PATENT DOCUMENTS

EP 1533279 5/2005
WO 2015162338 10/2015

OTHER PUBLICATIONS

International Application No. PCT/EP2022/074950—Patent Cooperation Treaty PCT Written Opinion of the International Searching Authority—Dec. 2, 2022 (mailed Dec. 9, 2022).
(Continued)

*Primary Examiner* — Jonathan Miller
(74) *Attorney, Agent, or Firm* — Workman Nydegger

(57) ABSTRACT

The torrefaction unit 1 comprises at least one multiple hearth furnace 2 which is heated by a heat transfer fluid 16 comprising hot water taken from a water space 21 of a steam drum 11. The heat transfer fluid 16 is guided through a water circuit 20 to a heating system 19 of the at least one multiple hearth furnace 2. This means the multiple hearth furnace 2 is heated to a torrefaction temperature indirectly by the use of hot water as heat transfer fluid 16. This is environmentally advantageous. The torrefaction gas 3 created by the torrefaction of material comprising biomass such as municipal solid waste is preferably partially oxidized in a partial oxidation reactor 23 for creating syngas. Preferably, a part of the thermal energy of the syngas is used in an evaporator 9 and/or a superheater 13 to heat water and/or steam and/or to evaporate water. The evaporated water is preferably guided
(Continued)

to a steam space 22 of the steam drum 11 and can, thus, be used to heat the heat transfer fluid 16. The partial oxidation reactor 23 and the temperature of the heat transfer fluid 16 can be controlled independently allowing to one single partial oxidation reactor 23 for at least two multiple hearth furnaces 2.

12 Claims, 1 Drawing Sheet

(51) Int. Cl.

| | |
|---|---|
| ***C10B 53/02*** | (2006.01) |
| ***C10B 57/02*** | (2006.01) |
| ***C10B 57/14*** | (2006.01) |
| ***C10J 3/72*** | (2006.01) |

(52) U.S. Cl.
CPC ..... *C10B 57/14* (2013.01); *C10J 3/725* (2013.01); *C10J 2300/0916* (2013.01)

(56) References Cited

U.S. PATENT DOCUMENTS 8,161,663 B2 * 4/2012 Weisselberg ..... C10L 9/083 202/109
8,246,788 B2 * 8/2012 Teal ..... C10B 1/10 202/136
8,266,821 B2 * 9/2012 Weisselberg ..... C10L 5/447 201/14
8,276,289 B2 * 10/2012 Causer ..... F23G 5/027 202/95
8,282,694 B2 * 10/2012 Hitchingham ..... C10L 5/445 48/209
8,394,240 B2 * 3/2013 Rinker ..... C10G 1/02 201/31
9,102,876 B2 * 8/2015 Lampe ..... F26B 21/14
9,683,187 B2 * 6/2017 Prud'Homme ..... C10L 5/40
2010/0242351 A1 * 9/2010 Causer ..... F23G 5/04 110/224
2011/0011719 A1 * 1/2011 Rinker ..... C10G 1/00 201/3
2011/0154684 A1 * 6/2011 Lundgen ..... C10L 5/44 34/201
2011/0173888 A1 * 7/2011 Hitchingham ..... C10L 5/442 48/209
2012/0137538 A1 * 6/2012 Lampe ..... C10B 7/02 34/487
2012/0233914 A1 * 9/2012 Causer ..... C10B 49/02 44/605

OTHER PUBLICATIONS

International Application No. PCT/EP2022/074950—Patent Cooperation Treaty PCT International Search Report—Completed Dec. 2, 2022 (mailed Dec. 9, 2022).
Luis E. Arteaga Perez et al., Steam Torrefaction of Eucalyptus Globulus for Producing Black Pellets: A Pilot Scale—Experience—Bioresource Technology—Apr. 2017—238 (2017) 194-204—Elsevier Ltd.
Extended European Search Report and Search Opinion received for European Application No. 21200579.7, mailed on Apr. 4, 2022, 9 pages.
International Preliminary Report on Patentability received for PCT Patent Application No. PCT/EP2022/074950, mailed on Apr. 11, 2024, 8 pages.
Office Action received for European Patent Application No. 21200579.7, mailed on Sep. 3, 2025, 8 pages.

* cited by examiner

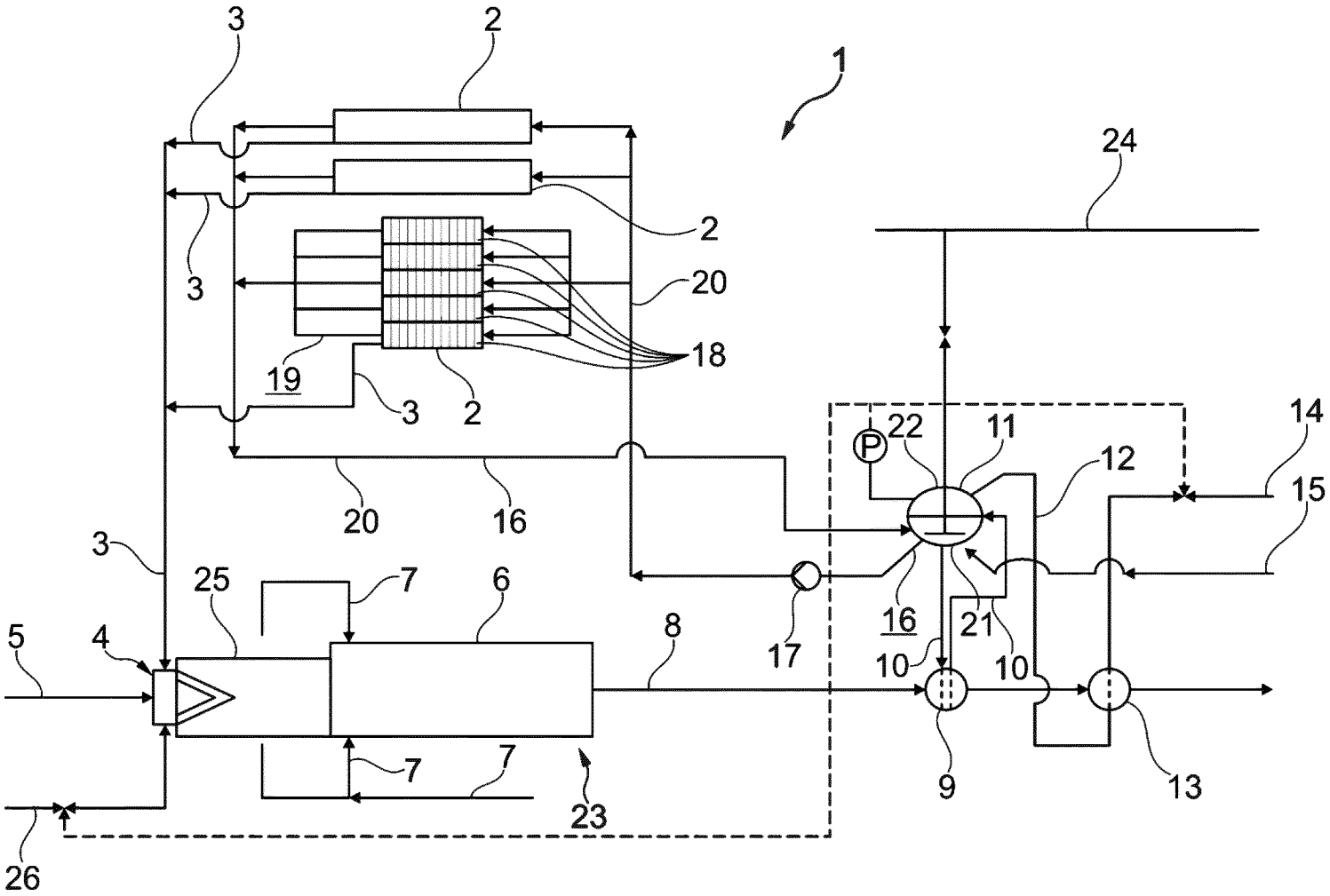
1
2
3
4
5
6
7
8
9
10
11
12
13
14
15
16
17
18
19
20
21
22
23
24
25
26
P

TORREFACTION UNIT AND METHOD

This application is a national phase of PCT Application No. PCT/EP2022/074950 filed Sep. 8, 2022, the contents of which are hereby incorporated by reference.

Subject matter of the present invention is a torrefaction unit as well as a method for torrefaction of biomass containing material. The invention is particularly applicable to the torrefaction of waste, in particular municipal solid waste, preferably in the form of solid recovered fuel pellets.

Torrefaction is known in processing municipal wastes, e.g. from the unpublished European patent application EP20204801.3. Torrefaction is understood as a process in which material such as waste is heated to temperatures of up to 300° C. in the absence of oxygen. The products of this torrefaction are a torrefaction gas comprising water, carbon monoxide, carbon dioxide, smaller oxygenated hydrocarbons and tars, and the charred solids remaining from the waste.

Usually, the heating value of the volatiles is converted into heat in an oxidizing unit. The residual heat generated in this oxidizing unit can be used for heating the torrefaction process. This is known to be done using an oil such as a thermal oil as a heat transfer medium. This has certain disadvantages, such as the necessity to provide a large inventory of the used oil and the general use of a hazardous material which needs specific measures to avoid leakage into the environment. Furthermore, the coupling of the torrefaction furnace and the oxidizing unit creates further issues. The control of this combined system has been found to be complex, furthermore, to be prepared for all possible circumstances it is necessary to provide auxiliary fuel to the oxidizing chamber in case of a shortage of heat and to provide a cooler for cooling the oil in case of a surplus of heat.

Based on this it is an object of the present invention to overcome the disadvantages known from prior art at least in part. This is solved by the features of the independent claims. The respective dependent claims are directed to advantageous embodiments of the invention.

The torrefaction unit for the torrefaction of a material comprising biomass according to the present invention comprises at least one multiple hearth furnace, said multiple hearth furnace comprising a heating system which can be flown through by a heat transfer fluid, wherein the heating system is connected to a water circuit by which water is heatable and conveyable through the heating system.

The term multiple hearth furnace is understood as a furnace having several hearths or kilns superimposed on each other, whereas the material is applied at the top of the multiple hearth furnace and is moved through the multiple hearth furnace by rotating conveying elements. The material is moved from the top to the bottom of the multiple hearth furnace while openings allow the transfer from an upper hearth to a respective lower hearth.

The material comprising biomass, in the following designated as the material, comprises preferably municipal solid waste, solid recovered fuel pellets, industrial waste and/or biomass, e.g. wood, plant fibers, sludge etc.

The water can be provided as liquid and/or steam, preferably as liquid. The operating temperature of the torrefaction furnace is usually in the range of 200° C. to 300° C., preferably in the range of 280° C. to 320° C. The temperature of the water when entering the heating system of the multiple hearth furnace is preferably controlled to be slightly above the operating temperature of the torrefaction furnace, preferably about 30° C. to 50° C. above the operating temperature. The flow of the water through the heating system is preferably controlled such that the temperature of the water when leaving the heating system of the multiple hearth furnace is 15° C. to 25° C. below the temperature of the water when entering the heating system. The use of water as heat transfer fluid has the advantage that in case of a leak only water is emitted into the furnace. Furthermore, the hot water can be used preferably from an existing water/steam cycle. This reduces the apparative expense and allows to extend an existing facility by a torrefaction unit according to the present invention without the necessity to install a thermal oil cycle including a large reservoir and the respective safety measures to avoid leakage to the environment. Furthermore, the option to connect to an existing steam/water cycle, e.g. including a steam drum, reduces the control effort to control the temperature in the heating system of the multiple hearth furnace significantly.

Preferably, the torrefaction unit further comprises a partial oxidation reactor including a burning chamber being connected to the at least one multiple hearth furnace for the partial oxidation of torrefaction gas with oxygen creating a syngas. The torrefaction gas is the gaseous product of the torrefaction and comprises water, carbon monoxide, carbon dioxide, hydrocarbons, oxygenated hydrocarbons and/or tar, depending on the material which undergoes torrefaction. The torrefaction gas is processed in the partial oxidation independently of the processing of the charred solids being the further product of the torrefaction. The partial oxidation of the torrefaction gas generates syngas, comprising at least hydrogen and carbon monoxide, and, depending on the conditions under which the reaction takes place, carbon dioxide and moisture.

The syngas is preferably used to synthesize further substances, e.g. synthetic natural gas, ammonia and methanol. This allows to synthesize substances based on waste or biomass. The syngas is preferably quenched with cooler syngas. The abrupt reduction of the temperature in the syngas results in any solids or melted solids present in the syngas are solidified and can be extracted from the process.

Preferably, a single partial oxidation reactor is connected to at least two multiple hearth furnaces. As based on the invention it is not necessary to directly use the thermal energy generated in the partial oxidation reactor to heat the multiple hearth furnace but to use a hot water source such as a steam drum as a source for thermal energy, while, preferably, providing thermal energy generated in the partial oxidation in the partial oxidation reactor to the steam drum instead it is possible to combine at least two multiple hearth furnaces with a single partial oxidation reactor. With the preferred embodiment it is, thus, possible to control the at least two multiple hearth furnaces separately from the single partial oxidation reactor. This reduces invest for hardware significantly as e.g. no additional cooler or a burner being providable with auxiliary fuel is necessary as well as the footprint of the necessary equipment.

Preferably, the torrefaction unit further comprises a steam drum having a steam space and a water space, wherein the water circuit is connected to the water space of the steam drum. Thus, it is easily possible to provide liquid hot water from the water space to the at least one multiple hearth furnace. Hot water can be easily generated using the respective boiler of which the steam drum is a part. The use of a steam drum as a source for hot water allows to easily retrofit the torrefaction unit into existing plants having a boiler with a steam drum.

Preferably, the water space and the steam space of the steam drum are in fluid connection with an evaporator which is heatable by syngas generated by partial oxidation of torrefaction gas. This allows to guide already hot water from the water space of the steam drum to the evaporator to at least in part evaporate the water to create steam or a mixture of steam and liquid water which can be guided to the steam space of the steam drum for phase separation. Simultaneously, the thermal energy of the syngas can be used to evaporate the water creating steam for the steam drum.

Preferably, the steam space of the steam drum is in fluid connection with a superheater which is heatable by syngas generated by partial oxidation of torrefaction gas. This allows to further use the thermal energy of the syngas. Preferably, the evaporator is situated upstream of the superheater such that the thermal energy of the syngas entering the superheater is already lower compared to the thermal energy of the syngas entering the evaporator.

According to a further aspect of the present invention a method for the torrefaction of a material comprising biomass is proposed, wherein the material is heated to a torrefaction temperature in at least one multiple hearth furnace, wherein the atmosphere in the at least one multiple hearth furnace is controlled to provide a substoichiometric amount of oxygen, preferably to be a virtually oxygen free atmosphere, wherein the at least one multiple hearth furnace is heated by a heat transfer fluid comprising water.

The term virtually oxygen-free atmosphere is to be understood as an atmosphere having a volume content of oxygen of less than 1 vol.-%, being than the lower explosion limit. Preferably, the atmosphere in the at least one multiple hearth furnace is controlled to be below the lower explosion limit. The torrefaction temperature is preferably within the range of 200° C. to 300° C., preferably in the range of 280° C. to 300° C. The heat transfer fluid is preferably liquid water and/or steam, preferably liquid water, preferably water being conditioned for reducing corrosion to be used in drum boilers, in particular high pressure drum boilers. The at least one multiple hearth furnace is solely heated by the heat transfer fluid. No further fuel is introduced into the multiple hearth furnace beside the material to be torrefied. The use of water as a heat transfer fluid overcomes the problems associated with the use of thermal oil as a heat transfer fluid.

Preferably, torrefaction gas is generated by the torrefaction of the material, said torrefaction gas being partially oxidized to generate a syngas. Preferably, solely the torrefaction gas is partially oxidized, in particular separately from the possible further treatment of the charred material being the other product of the torrefaction process. The partial oxidization resulting in a syngas allows in particular to use chemical compounds of waste or biomass to synthesize further chemical compounds.

Preferably, the torrefaction gas of at least two multiple hearth furnaces is partially oxidized in a single partial oxidation reactor. The use of water as a heat transfer medium and in particular the use of an existing water/steam cycle as a source of the water used as the heat transfer fluid reduces the complexity of the control of the torrefaction furnace and the partial oxidation reactor significantly, as thermal energy generated during the partial oxidization is not directly used to heat the torrefaction furnace but is at most used to heat the water in the water/steam cycle, thus decoupling the control of the partial oxidation reactor from the control of the torrefaction furnace. Preferably, water originating from a respective boiler (boiler water) is used as the heat transfer medium.

Preferably, the heat transfer fluid comprises water taken from a steam drum. The respective water is preferably conditioned as boiler water to reduce corrosion in the boiler and the respective water/steam cycle. A steam drum is understood in this document as a reservoir of liquid water and steam usually disposed at the top end of a boiler and its water tubes. The steam drum stores the steam generated e.g. in the boiler in a steam space while liquid water is stored in a water space. The steam drum acts as a phase separator for the steam and liquid water mixture. The use of a steam drum as a source for hot water allows to retrofit a respective torrefaction furnace in an existing plant having a boiler.

Preferably, the heat transfer fluid is guided in a water circuit from the steam drum through a heating system of the at least one multiple hearth furnace and back to the steam drum. This allows an easy control of the torrefaction temperature in the at least one multiple hearth furnace. Further, this allows to retrofit a torrefaction unit to an existing plant having a boiler with a steam drum.

Preferably, torrefaction gas is generated by the torrefaction of the material, said torrefaction gas being partially oxidized to generate a syngas, the syngas being used to at least in part evaporate water provided from a water space of said steam drum, wherein the at least partly evaporated water is provided to a steam space of said steam drum after evaporation. The heat transfer from the syngas to the water is an indirect heat transfer performed in an evaporator. This allows to use a part of the thermal energy of the syngas for the evaporation. As the thermal energy is transferred not directly to the multiple hearth furnace but to a steam drum from which the heat transfer fluid is taken this allows a separation of the control of the partial oxidation generating the syngas on the one hand and of the at least one multiple hearth furnace on the other hand.

Preferably, torrefaction gas is generated by the torrefaction of the material, said torrefaction gas being partially oxidized to generate a syngas, the syngas being used to superheat steam provided from a steam space of the steam drum. This allows a use of a part of the thermal energy of the syngas for superheating steam which is taken from the steam space of the steam drum and is then guided to at least one steam consumer. Preferably, the use of thermal energy of the syngas for evaporating water and for superheating steam are used in combination as this allows to use a significant amount of the thermal energy for heating usable media (i.e. water and steam). Preferably, with respect to the flow of syngas the superheating happens downstream of the evaporation.

Preferably, the atmosphere in the at least one multiple hearth furnace is controlled to provide an oxygen content of less than 1 vol.-%. This means that an atmosphere being virtually free of oxygen is kept in the multiple hearth furnaces to allow a torrefaction without oxidation processes of the material. Thus, the atmosphere in the at least one multiple hearth furnace is controlled to be below the lower explosion limit.

It should be noted that the individual features specified in the claims may be combined with one another in any desired technologically reasonable manner and form further embodiments of the invention. The specification, in particular taken together with the FIGURES, explains the invention further and specifies particularly preferred embodiments of the invention. Particularly preferred variants of the invention and the technical field will now be explained in more detail with reference to the enclosed figures. It should be noted that the exemplary embodiment shown in the FIGURES is not intended to restrict the invention. The figures are schematic and may not be to scale. The single FIGURE displays:

FIG. 1 a process scheme of the torrefaction unit.

FIG. 1 displays a torrefaction unit 1. The torrefaction unit 1 comprises in this example three multiple hearth furnaces 2 two of which are only displayed very schematically. In each multiple hearth furnace 2 a material comprising biomass is torrefied, i.e. heated within in an atmosphere which is substoichiometric regarding an oxidation of the material at temperatures of up to 300° C. and is preferably virtually free of oxygen, i.e. is having an oxygen content of less than 1 vol.-%. Each multiple hearth furnace 2 comprises several hearths 18. The material is applied to the uppermost hearth 18 and is conveyed around each hearth 18 and downwards from hearth 18 to hearth 18. The multiple hearth furnace 2 is heated to a torrefaction temperature, e.g. to about 300° C. This is performed by a heating system 19. The heating system 19 comprises ducts through which hot water is conveyed to heat the multiple hearth furnace 2 indirectly. The water is provided to the heating system 19 from a water circuit 20. The water is preferably boiler water, i.e. conditioned to reduce corrosion in a boiler water/steam cycle.

By the torrefaction, volatiles of the material are released comprising water, carbon monoxide, carbon dioxide, smaller oxygenated hydrocarbons and tars. The remaining solid material taken from of the multiple hearth furnace 2 is improved regarding its grindability and can be used in different processes. A further product of the torrefaction process is, thus, a torrefaction gas 3 comprising the volatiles. Preferably, the torrefaction gas 3 is provided via a burner 4 to burning chamber 25 for partial oxidization with oxygen from an oxygen comprising gas 5, preferably pure oxygen. Auxiliary fuel 26 can be provided to the burner 4 as well, in particular for starting up. A control line is depicted as a dashed line by which valves regulating the flow of auxiliary fuel 26 and/or superheated steam 14, in particular based on the pressure in a steam space 22 of the steam drum 11, are controllable.

One product of this partial oxidation is syngas which is quenched with cooler quenching syngas 7 in a quenching chamber 6 resulting in a cooled syngas 8 which is provided to an evaporator 9. Solids or melted solids in the syngas are solidified due to the quenching process and are preferably removed from the syngas.

The cooled syngas 8 after quenching has a temperature of e.g. 730° C. to 770° C. A part of the thermal energy of the cooled syngas 8 is used to at least partly evaporate water 10. Said water 10 is provided from a water space 21 of a steam drum 11 and is returned to a steam space 22 of the steam drum 11. Steam 12 from the steam space 22 of the steam drum 11 is guided via a superheater 13 to superheat the steam 12 using thermal energy from the cooled syngas 8 generating superheated steam 14 which can be used in at least one steam consumer (not shown) in which the steam is used e.g. to drive a turbine, to feed a dryer etc. The superheated steam 14 has a temperature of e.g. 340° C. to 360° C. and a pressure of 130 bar to 150 bar. Downstream of the superheater 13 the cooled syngas 8 can be further used e.g. for synthesizing longer chemical molecules, e.g. methanol or the like. Boiler feedwater 15 can be used to provide the steam drum 11 with liquid water. Boiler feedwater 15 has preferably a conductivity of less than 5 μS/cm [mikrosiemens per centimeter]. Boiler feedwater 15 is preferably conditioned for anti-corrosive properties, preferably by providing ammonia to the boiler feedwater 15.

The steam drum 11 is part of the water circuit 20. Heat transfer fluid 16 comprising hot boiler water from the water space 21 of the steam drum 11 is conveyed by a pump 17 through the ducts of the water circuit 20 to heating system 19 of at least one multiple hearth furnace 2.

The steam drum 11 is controlled such that the heat transfer fluid 16 is taken from the water space 21 as liquid and has preferably a temperature from 335° C. to 345° C. when exiting the steam drum 11. The heat transfer fluid 16 is guided through respective heating ducts of the heating system 19 in the walls of the at least one multiple hearth furnace 2, preferably in the ceilings of respective stages of the multiple hearth furnaces 2, to heat the interior of the multiple hearth furnace 2 to the torrefaction temperature. After having heated the multiple hearth furnace 2 the heat transfer fluid 16 is returned to the steam drum 11 via the water circuit 20. Usually, the temperature of the heat transfer fluid 16 downstream the multiple hearth furnace 2 is reduced by 15° C. to 25° C. compared to the temperature of the heat transfer fluid 16 upstream of the multiple hearth furnace 2.

Preferably, the steam space 22 of the steam drum 11 is connectable to a steam grid 24. This allows to use steam from an external source to start-up the steam drum 11, if necessary.

The torrefaction unit 1 comprises at least one multiple hearth furnace 2 which is heated by a heat transfer fluid 16 comprising hot water taken form a water space 21 of a steam drum 11. The heat transfer fluid 16 is guided through a water circuit 20 to a heating system 19 of the at least one multiple hearth furnace 2. This means the multiple hearth furnace 2 is heated to a torrefaction temperature indirectly by the use of hot water as heat transfer fluid 16. This is environmentally advantageous. The torrefaction gas 3 created by the torrefaction of material comprising biomass such as municipal solid waste is preferably partially oxidized in a partial oxidation reactor 23 for creating syngas. Preferably, a part of the thermal energy of the syngas is used in an evaporator 9 and/or a superheater 13 to heat water and/or steam and/or to evaporate water. The evaporated water is preferably guided to a steam space 22 of the steam drum 11 and can, thus, be used to heat the heat transfer fluid 16. The partial oxidation reactor 23 and the temperature of the heat transfer fluid 16 can be controlled independently allowing to one single partial oxidation reactor 23 for at least two multiple hearth furnaces 2.

REFERENCE NUMERALS

1 torrefaction unit
2 multiple hearth furnace
3 torrefaction gas
4 burner
5 oxygen comprising gas
6 quenching chamber
7 quenching syngas
8 cooled syngas
9 evaporator
10 water
11 steam drum
12 steam
13 superheater
14 superheated steam
15 boiler feedwater
16 heat transfer fluid
17 pump
18 hearth
19 heating system
20 water circuit
21 water space
22 steam space
23 partial oxidation reactor
24 steam grid
25 burning chamber
26 auxiliary fuel

The invention claimed is:

1. A torrefaction unit (1) for the torrefaction of a material comprising biomass, comprising:

at least one multiple hearth furnace (2), said multiple hearth furnace (2) comprising a heating system (19) which is configured to be flown through by a heat transfer fluid (16), wherein the heating system (19) is connected to a water circuit (20) by which water is heatable and conveyable as the heat transfer fluid (16) through the heating system (19), and wherein a single partial oxidation reactor (23) is connected to at least two multiple hearth furnaces (2).

2. A torrefaction unit (1) according to claim 1, further comprising a partial oxidation reactor (23) including a burning chamber (4) being connected to the at least one multiple hearth furnace (2) for the partial oxidation of torrefaction gas (3) with oxygen creating a syngas (8).

3. A torrefaction unit (1) according to claim 1, further comprising a steam drum (11) having a steam space (22) and a water space (21), wherein the water circuit (20) is connected to the water space (21) of the steam drum (11).

4. A torrefaction unit (1) according to claim 3, wherein the water space (21) and the steam space (22) of the steam drum (11) are in fluid connection with an evaporator (9) which is heatable by syngas (8) generated by partial oxidation of torrefaction gas (3).

5. A torrefaction unit (1) according to claim 3, wherein the steam space (22) of the steam drum (11) is in fluid connection with a superheater (13) which is heatable by syngas (8) generated by partial oxidation of torrefaction gas (3).

6. A method for the torrefaction of a material comprising biomass, the method comprising:

heating the material to a torrefaction temperature in at least one multiple hearth furnace (2), wherein the atmosphere in the at least one multiple hearth furnace (2) is controlled to provide a sub-stoichiometric amount of oxygen, wherein the at least one multiple hearth furnace (2) is heated by a heat transfer (16) fluid comprising water, and wherein the torrefaction gas (3) of at least two multiple hearth furnaces (2) is partially oxidized in a single partial oxidation reactor (23).

7. A method according to claim 6, wherein torrefaction gas (3) is generated by the torrefaction of the material, said torrefaction gas (3) being partially oxidized to generate a syngas (8).

8. A method according to claim 6, wherein the heat transfer fluid (16) comprises water taken from a steam drum (11).

9. A method according to claim 8, wherein the heat transfer fluid (16) is guided in a water circuit (20) from the steam drum (11) through a heating system (19) of the at least one multiple hearth furnace (2) and back to the steam drum (11).

10. A method according to claim 8, wherein torrefaction gas (3) is generated by the torrefaction of the material, said torrefaction gas (3) being partially oxidized to generate a syngas (8), the syngas (8) being used to at least in part evaporate water (10) pro-vided from a water space (21) of said steam drum (11), wherein the at least partly evaporated water (10) is provided to a steam space (22) of said steam drum (11) after evaporation.

11. A method according to claim 8, wherein torrefaction gas (3) is generated by the torrefaction of the material, said torrefaction gas (3) being partially oxidized to generate a syngas (8), the syngas (8) being used to superheat steam (12) provided from a steam space (22) of the steam drum (11).

12. A method according to claim 6, wherein the atmosphere in the at least one multiple hearth furnace (2) is controlled to provide an oxygen content of less than 1 vol.-%.

* * * * *